US010260380B2

(12) United States Patent
Schmidt et al.

(10) Patent No.: US 10,260,380 B2
(45) Date of Patent: Apr. 16, 2019

(54) LOCKING DEVICE FOR A SWITCHABLE VALVE DRIVE COMPONENT

(71) Applicant: Schaeffler Technologies AG & Co. KG, Herzogenaurach (DE)

(72) Inventors: Volker Schmidt, Burgbernheim (DE); Frank Himsel, Obermichelbach (DE); Rainer Schwinn, Obermichelbach (DE); Michael Kugler, Vestenbergsgreuth (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 152 days.

(21) Appl. No.: 15/502,290

(22) PCT Filed: Jun. 12, 2015

(86) PCT No.: PCT/DE2015/200363

§ 371 (c)(1),
(2) Date: Feb. 7, 2017

(87) PCT Pub. No.: WO2016/023543

PCT Pub. Date: Feb. 18, 2016

(65) Prior Publication Data

US 2017/0234172 A1 Aug. 17, 2017

(30) Foreign Application Priority Data

Aug. 13, 2014 (DE) ..... 10 2014 216 058

(51) Int. Cl.
*F01L 1/14* (2006.01)
*F01L 1/16* (2006.01)
(Continued)

(52) U.S. Cl.
CPC ..... *F01L 1/16* (2013.01); *F01L 1/14* (2013.01); *F01L 1/18* (2013.01); *F01L 1/267* (2013.01);
(Continued)

(58) Field of Classification Search
CPC ..... F01L 1/14; F01L 2001/186; F01L 1/46
(Continued)

(56) References Cited

U.S. PATENT DOCUMENTS 5,427,064 A * 6/1995 Murata ..... F01L 1/267 123/90.16
5,544,626 A 8/1996 Diggs et al.
(Continued)

FOREIGN PATENT DOCUMENTS

DE 102005048951 5/2007
DE 102008013566 10/2008
(Continued)

*Primary Examiner* — Jorge Leon, Jr.
(74) *Attorney, Agent, or Firm* — Volpe and Koenig, P.C.

(57) ABSTRACT

The invention relates to a locking device for a switchable valve drive component, including a first locking body and a second locking body which can be brought into engagement with one another or out of engagement in order to couple to one another or to uncouple two component parts arranged movably with respect to one another, wherein at least one of the two locking bodies has at least one curved surface. In order to increase the wear resistance of the locking device, provision is made for at least one of the two locking bodies to have a plurality of curved surfaces of which the respective curvature is described by radii of identical length having constructional center points spaced apart from one another.

6 Claims, 2 Drawing Sheets

(51) Int. Cl.

| | |
|---|---|
| ***F01L 1/26*** | (2006.01) |
| *F01L 1/18* | (2006.01) |
| *F01L 1/46* | (2006.01) |
| *F01L 13/00* | (2006.01) |

(52) U.S. Cl.
CPC ..... *F01L 13/0031* (2013.01); *F01L 13/0036* (2013.01); *F01L 1/46* (2013.01); *F01L 13/0005* (2013.01); *F01L 2001/186* (2013.01)

(58) Field of Classification Search
USPC ..... 123/90.39, 90.42, 90.5
See application file for complete search history.

(56) References Cited

U.S. PATENT DOCUMENTS

| | | | | |
|---|---|---|---|---|
| 5,549,081 | A * | 8/1996 | Ohlendorf ..... | F01L 1/267 123/90.16 |
| 8,863,716 | B2 | 10/2014 | Dorn et al. | |
| 2006/0249113 | A1 | 11/2006 | Kuckuk | |
| 2008/0264370 | A1 | 10/2008 | Shewell | |

FOREIGN PATENT DOCUMENTS

| | | |
|---|---|---|
| DE | 102010026360 | 1/2012 |
| DE | 102012016672 | 2/2014 |
| EP | 0652353 | 5/1995 |

* cited by examiner

LOCKING DEVICE FOR A SWITCHABLE VALVE DRIVE COMPONENT

BACKGROUND

The invention relates to a locking device for a switchable valve drive component, with a first locking body and a second locking body that can be brought into engagement with each other or can be brought out of engagement with each other in order to couple or uncouple two components that are arranged movably with respect to one another, wherein at least one of the two locking bodies has at least one curved surface.

Switchable valve train components, such as switchable cam followers, switchable rocker arms, switchable finger levers, or switchable tappets, are used as cam followers in internal combustion engines in order to reduce the fuel consumption and pollutant emissions. For this purpose, switchable cam followers allow, under certain operating situations, a switching between different stroke curves that are transmitted from different cams of a camshaft to one or more valves, or a temporary complete shutdown of one or more cylinders. For such valve train components, a locking device enables the fixed connection or the detachment of actuation-relevant individual parts of these same components.

A locking device of such a valve train component is formed of a locking element, for example, a piston that can be actuated in a mechanical-hydraulic way and can be spring-mounted, as well as a holder, for example, a hole, with which the piston is brought into engagement or brought out of engagement as necessary, in order to couple or decouple two components, for example, rocker arms, which move in a pivoting or linear motion relative to each other.

For known locking devices, the locking partners each have a circular cross-section with essentially uniform radius, wherein the radius of the piston is necessarily somewhat smaller than the radius of the holder for the piston. In this way, in the locked state, a linear contact with only one contact line in the longitudinal direction is produced on the locking contact surfaces. Such locking devices therefore have relatively poor osculation of the locking partners and therefore comparatively high bearing pressure. The wear is high accordingly due to the locking and unlocking that occurs frequently during operation. Independent of an actuating device and the size of the radii of the locking device, an imprecise alignment of the piston in the holder in the horizontal direction or an imprecise crown position of the piston is also produced, from which a disadvantageous variance in the locking play of the locking device is produced.

For other known locking devices, the two locking partners each have a rectangular profile. The bearing pressure is indeed usually low for these locking elements, but the production requires relatively high processing costs.

U.S. Pat. No. 5,544,626 A shows a two-part switchable cam follower in which, between two longitudinal bars of a box-shaped first arm, a second arm is installed so that it can pivot relative to the first arm. The two arms can be locked to each other by a piston installed in the longitudinal direction of the cam follower. The piston has a circular cross-section and is supported so that it can move longitudinally in a hole of the first arm with a similarly circular cross-section. The piston has a flattened axial end piece that can be brought into engagement in a positive locking arrangement with a flat bottom side of the second arm for locking the cam follower.

DE 10 2005 048 951 A1 shows a two-part switchable cam follower with a larger outer lever with respect to an opposing rotational axis and a smaller inner lever, wherein the inner lever can pivot relative to the outer lever. The two levers can be locked with each other by a locking pin. The locking pin is held in the longitudinal direction in the outer lever and is supported so that it can move longitudinally and can be brought into engagement with the inner lever. The locking pin is actuated in a mechanical-hydraulic way, in order to lock the outer lever rigidly to the inner lever as needed.

From DE 10 2010 026 360 A1, a tappet for a valve train is known in which, in a window of a housing, there is an anti-rotation securing device projecting past the outer lateral surface of the housing. The housing is held in a guide hole of a surrounding construction not described in more detail. The guide hole has a partial cylindrical axial guide in cross-section, in which the anti-rotation securing device engages. The anti-rotation securing device is constructed as a finger-like, perpendicular half-cylindrical body with a relatively small cylindrical height in which the lateral surface nestles only partially against the axial guide and is not forced, so that an approximately point-shaped contact is produced between the anti-rotation securing device and a wall of the axial guide. The lateral surface of the anti-rotation securing device describes, in cross-section, a round taper formed of two circular arcs, a so-called gothic profile, wherein the tip of the round taper is replaced by a flattened section. Every possible contact point between the gothic profiled anti-rotation securing device and the partial cylindrical axial guide is due to the gothic profile spaced apart from the edge of the guide hole of the housing at which the anti-rotation securing device is especially at risk of wear.

SUMMARY

The invention is based on the objective of creating a locking device for a switchable valve train component that has a high wear resistance and nevertheless can be produced easily and economically.

The invention is based on the knowledge that for a locking device for a switchable valve train component, due to the combination of a cylindrical locking element with a contact geometry that enables two or more linear contacts between the locking partners, a reduced bearing pressure can be achieved in the locking mechanism, wherein its wear resistance is improved.

The invention therefore starts from a locking device for a switchable valve train component with a first locking body and a second locking body that can be brought into engagement with each other or can be brought out of engagement with each other, in order to couple or decouple two components that can move relative to each other, wherein at least one of the two locking bodies has at least one curved surface. It is also provided that at least one of the two locking bodies has multiple curved surfaces each with curvatures that are defined by radii of identical length with structural center points spaced apart from each other.

Through this construction, a locking device is provided in which the contact surfaces have a relatively small bearing pressure between the two locking bodies. This is achieved in that, from the cross-section of one or both locking partners, a multi-line contact, for example, a two-line contact, is produced in the longitudinal direction. Consequently, instead of a constant radius that defines a circular cross-section, the cross-section of at least one of the two locking bodies is comprised structurally either from multiple radii that are of equal size but do not start from the same point, or are formed from a radius that is not constant such that at least two contact lines spaced apart from each other are formed in the locked state. Therefore, relative to a one-line contact, a lower bearing pressure and a higher resistance capability against premature wear of the locking device is achieved. The period of use of the device can therefore increase and easy switchability remains guaranteed for a long period. Such an arrangement also enables improved precision with respect to the lateral alignment of the two locking bodies relative to each other. The switchable connection of the two components of the valve train components therefore shows lower variance of the locking play or the alignment of the locking bodies between the switching procedures.

A cylindrical body is also understood in the following to be a locking body that is formed by a closed guide curve and two parallel planes, the base surfaces of the body. A cylindrical holder is also understood to be an opening of a locking body that is formed by a closed or open guide curve that surrounds the opening and two parallel planes, the base surfaces of the opening. The cross-sections of the base surfaces can be profiles with different geometric shapes, such as simple circles or complex structures.

For an actual embodiment of the invention, the advantageous multi-line contact can be generated relatively easily and without significant additional production costs such that the first locking body is constructed as a cylindrical piston with a circular outer circumferential surface, the second locking body has a roundly tapered holder in cross-section for the first locking body, the roundly tapered holder is formed by two curved surfaces, and each curvature of the two surfaces of the roundly tapered holder is defined by radii of identical length, which however, have different structural center points, so that, in the locked state, two contact lines are active in the longitudinal direction of the two locking bodies between the first locking body and the second locking body.

Consequently, the cross-section of a holder in which a circular cylindrical piston is to be held can be constructed with two identical radii or circular arcs whose structural center points are spaced apart from each other and whose radii are greater than the radius of the piston. In this way, a roundly tapered cross-section is produced whose base line, the so-called springing line, divides a circle in the middle. The piston thus engages in the longitudinal section with one axial half in the holder. A conventional pin can be used as the piston. For a symmetric construction of the roundly tapered profile on which the piston contacts during the locking, two contact lines are produced in the longitudinal direction that have a quarter circle distance from each other in the circumferential direction. To enable a complete enclosure of the piston in the holder, this can be constructed such that a second roundly tapered cross-section is arranged that is formed symmetric to the first roundly tapered section.

According to another embodiment of the invention, it is provided that the first locking body is constructed as a half-cylindrical piston that has a roundly tapered cross-section with two curved surfaces and in which the tip of the roundly tapered section of the piston is flattened, the curvatures of the two surfaces of the roundly tapered section of the piston are formed by two radii of identical length, which, however, start from different structural center points, and the second locking body is constructed as a hollow cylindrical holder for the first locking body, so that, in the locked state, two contact lines are active in the longitudinal direction of the two locking bodies between the first locking body and the second locking body. Due to this arrangement, a two-line contact is similarly produced. In this case, a conventional hole can be used as the axial holder. The piston has, in contrast, an essentially roundly tapered profile.

In another embodiment of the invention it can be provided that one of the two locking bodies has a parabola-shaped or parabola-like cross-section and the other of the two locking bodies has a circular cross-section. Such an arrangement also enables a multi-line contact between a piston and a piston holder.

In principle, other contact geometries with two contact lines or contact geometries with more than two contact lines between the locking bodies are also possible. Such cross-sections can be realized structurally with the help of three or more radii or by a varying radius. It is also possible that for achieving the lowest possible bearing pressure, both locking bodies have cross-sections that differ from a simple circular cross-section.

The locking device according to the invention is basically usable on all switchable valve train components. In a preferred application, it can be provided that it is integrated into a switchable valve train component that is constructed as a switchable cam follower of a valve train of an internal combustion engine, wherein the locking device is active between two rockers arms of the switchable cam follower supported so that they can pivot relative to each other, wherein the locking device is installed in the longitudinal direction or in the transverse direction of the switchable cam follower.

BRIEF DESCRIPTION OF THE DRAWINGS

The invention is explained in more detail below with reference to the accompanying drawings using two embodiments.

DETAILED DESCRIPTION OF THE PREFERRED EMBODIMENTS

Figure 1:
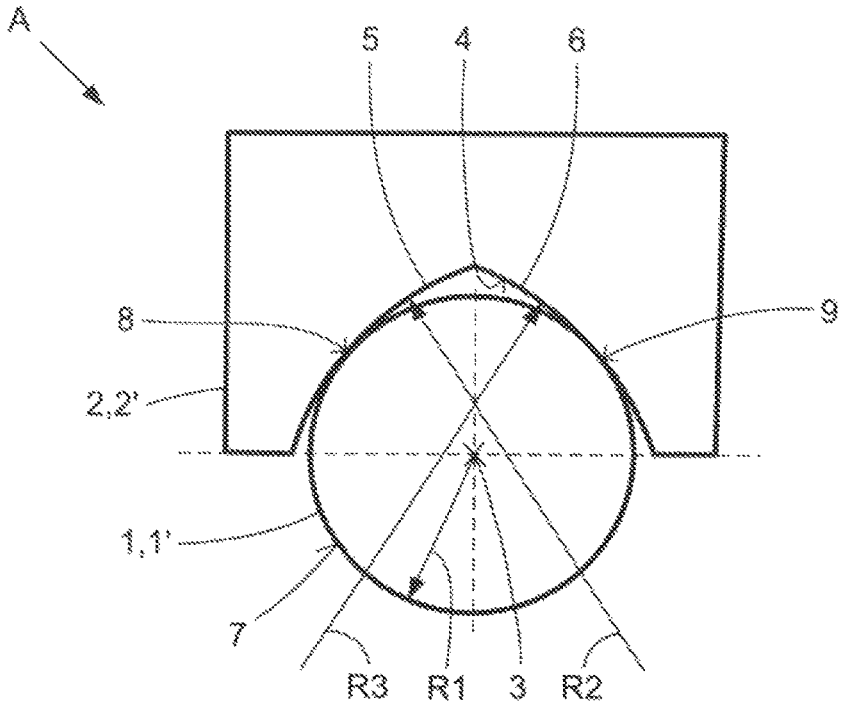
FIG. 1 a first locking device constructed according to the invention for a switchable valve train component in cross-section, FIG. 2 a second locking device constructed according to the invention for a switchable valve train component in cross-section, and FIG. 3 a locking device for a switchable valve train component in cross-section according to the prior art.
Figure 2:
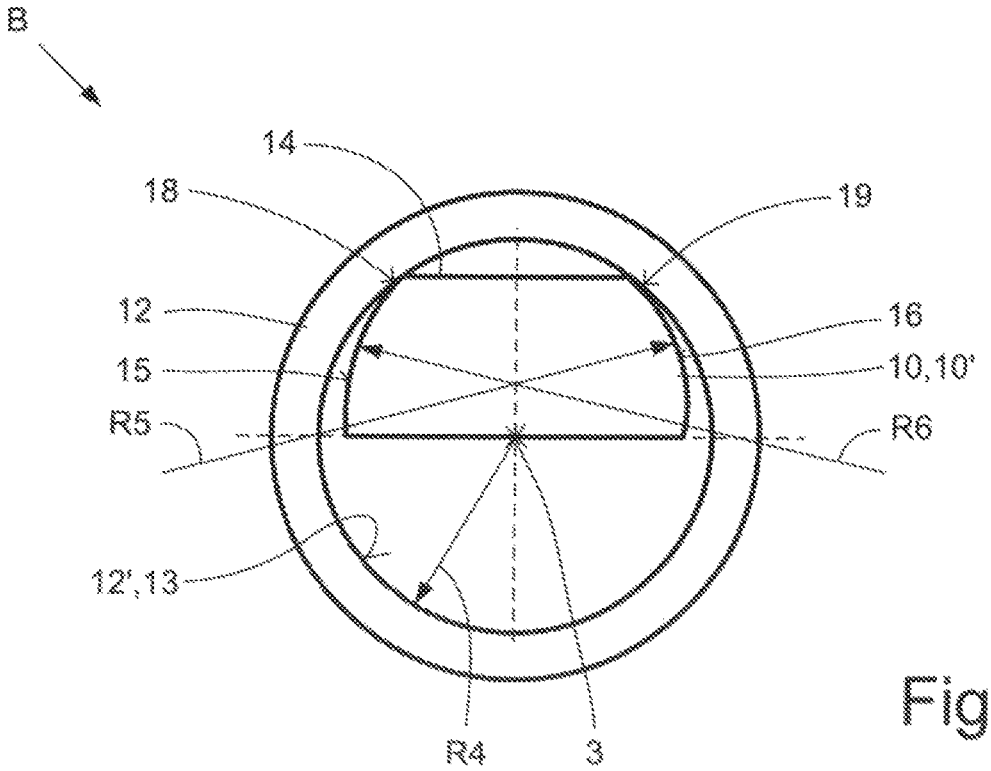

The locking devices A, B shown in FIGS. 1 and 2 can be integrated, for example, in a not-shown switchable cam follower of a valve train. The switchable cam follower has, for example, two not-shown rocker arms that are connected to each other so that they can pivot relative to each other. The locking devices A, B are used, for example, for the switchable coupling of a switching motion of the cam follower in order to switch between different cam strokes that are to be transferred when the internal combustion engine is running to an inlet valve or to an exhaust valve of an internal combustion engine. In this context, refer to the publications cited farther above.

The locking device A according to FIG. 1 has a first locking body 1 and second locking body 2. The first locking body 1 is constructed as a cylindrical piston 1' that has a circular cross-section with a first radius R1. The piston 1' engages with an axial longitudinal half, viewed in the longitudinal direction 3, in an approximately cylindrical, axial holder 4 of the second locking body 2. This holder 4 has a roundly tapered cross-sectional profile with two curved surfaces 5, 6 whose curvatures are defined by a second radius R2 and by a third radius R3, respectively. The second radius R2 and the third radius R3 are each of identical length, but their respective not exactly defined structural center points are spaced apart from each other so that, as a result, the roundly tapered cross-sectional profile is produced that is similar to a gothic arc.

The piston 1' nestles within the holder 4 with its outer circumferential surface 7 against the two curved surfaces 5, 6, so that exactly two contact lines 8, 9 are formed. A one-sided linear contact susceptible to wear on only one contact line is avoided. The lateral alignment of the piston 1' is defined by the roundly tapered cross-sectional profile of the holder 4 with two line contacts.

The locking device B according to FIG. 2 has a first locking body 10 and second locking body 12. The first locking body 10 is constructed as a half-cylindrical piston 10' with a cut radial tip 14. In this way, the piston 10' has two curved surfaces 15, 16 that extend axially and have curvatures defined by a fifth and sixth radius of curvature R5, R6, respectively. The fifth radius R5 and the sixth radius R6 are of identical length, but their respective not exactly defined structural center points are spaced apart from each other, so that, as a result, the cross-sectional geometry that can be seen in FIG. 2 for the first locking body 10 shown there is produced. The piston 10' engages with its axial longitudinal half shaped as defined in the hollow cylindrical holder 12' of a second cylindrical locking body 12. The holder 12' consequently has an inner circumferential surface 13 with a circular cross-section with a fourth radius of curvature R4 against which the piston 10' nestles, viewed in the longitudinal direction 3, with exactly two contact lines 18, 19. A one-sided line contact susceptible to wear on only one contact line is therefore successfully prevented.

Figure 3:
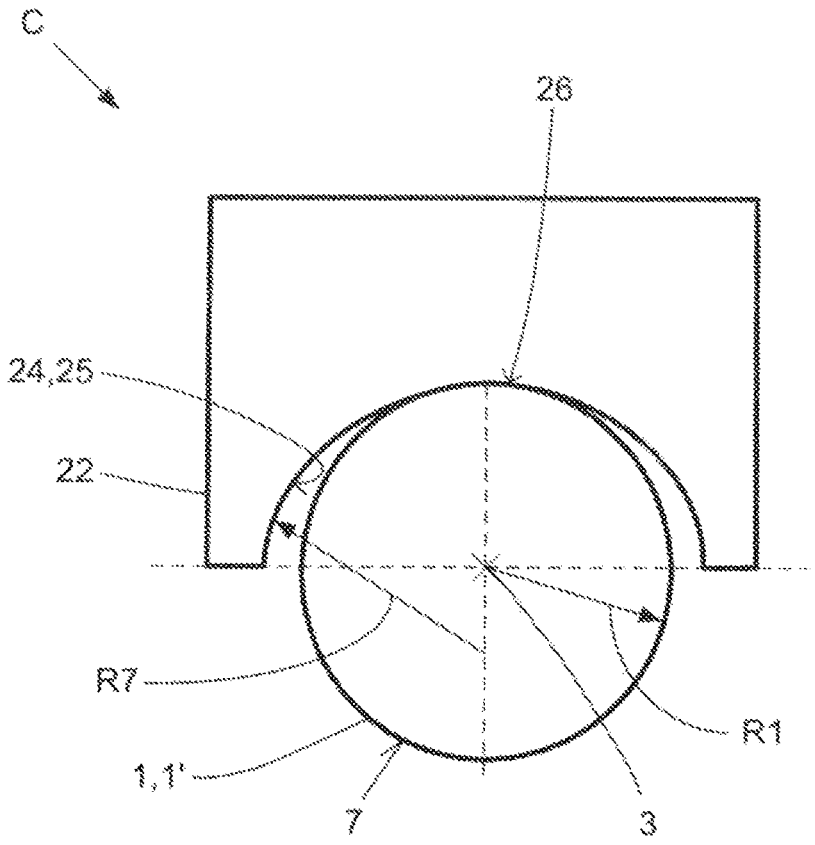
Fig.3 (Prior Art)

For comparison with the locking devices A, B according to the invention, FIG. 3 shows a conventional locking device C. This locking device C has a first locking body 1 and second locking body 22. The first locking body 1 is constructed as a cylindrical piston 1' with a circular outer circumferential surface 7, wherein the first radius R1 here also defines the curvature of the cylindrical piston 1'. The second locking body 22 has a cylindrical holder 24 or hole whose inner circumferential surface 25 is defined with respect to its curvature by a seventh radius R7. The seventh radius R7 is here greater than the first radius R1. The first locking body 1 nestles, viewed in the longitudinal direction 3, with its radial outer surface 7 against the inner circumferential surface 25 of the cylindrical holder 24 under formation of exactly one contact line 26, wherein the lateral position of the contact line 26 varies as a function of the locking play. It is easily comprehensible that in this known locking device C, a strong wear takes place in the area of the only contact line 26.

LIST OF REFERENCE NUMBERS

1 First locking body
1' Piston
2 Second locking body
3 Longitudinal axis of the piston 1'
4 Roundly tapered holder in second locking body 2
5 First surface of the holder 4
6 Second surface of the holder 4
7 Outer circumferential surface of the first locking body 1
8 First contact line
9 Second contact line
10 First locking body
10' Half-cylindrical piston
12 Second locking body
12' Hollow cylindrical holder of the second locking body 12
13 Cylindrical inner circumferential surface of the second locking body 12
14 Cut tip of the second locking body 12
15 First roundly tapered surface of the first locking body 10, 10'
16 Second roundly tapered surface of the first locking body 10, 10'
18 First contact line
19 Second contact line
22 Second locking body
24 Cylindrical holder of the second locking body 22
25 Inner circumferential surface of the second locking body 22
26 Contact line
A Locking device
B Locking device
C Locking device
R1 First radius
R2 Second radius
R3 Third radius
R4 Fourth radius
R5 Fifth radius
R6 Sixth radius
R7 Seventh radius

The invention claimed is:

1. A locking device for a switchable valve train component, the locking device comprising:

a first locking body and a second locking body that are brought into engagement with each other or are brought out of engagement with each other in order to couple or decouple two components arranged so that the two components are movable relative to each other, at least one of the first locking body or the second locking body has multiple curved surfaces at which the first locking body and the second locking body engage each other, the multiple curved surfaces each with curvatures that are defined by radii of identical length with structural center points that are spaced apart from each other.

2. The locking device according to claim 1, wherein the first locking body is constructed as a cylindrical piston with a circular outer circumferential surface, the second locking body has a holder with a roundly tapered cross-section for the first locking body, the roundly tapered cross-section is formed by two surfaces of the multiple curved surfaces, the respective curvatures of the two surfaces of the roundly tapered cross-section are defined by the radii having the identical lengths, which have the structural center points that are different, so that, in a locked state, two contact lines are active in a longitudinal direction of the first and second locking bodies between the first locking body and the second locking body.

3. The locking device according to claim 1, wherein the first locking body is constructed as a half-cylindrical piston that has a roundly tapered cross-section with two surfaces of the multiple curved surfaces and for which a tip of the roundly tapered cross-section of the piston is flattened, the curvatures of the two surfaces are formed by two corresponding radii having the identical lengths, which start from the structural center points that are different, and the second locking body is constructed as a hollow cylindrical holder for the first locking body, so that, in a locked state, two contact lines are active in a longitudinal direction of the first and second locking bodies between the first locking body and the second locking body.

4. The locking device according to claim 1, wherein the locking device is integrated in the switchable valve train component constructed as a switchable cam follower of a valve train of an internal combustion engine, the locking device is active between two rocker arms of the switchable cam follower supported so that the two rocker arms are pivotable relative to each other, and for which the locking device is installed in a longitudinal direction or in a transverse direction of the switchable cam follower.

5. A locking device for a switchable valve train component, the locking device comprising:

a first locking body and a second locking body that are brought into engagement with each other or are brought out of engagement with each other in order to couple or decouple two components arranged so that the two components are movable relative to each other, at least one of the first locking body or the second locking body has multiple curved surfaces each with curvatures that are defined by radii of identical length with structural center points that are spaced apart from each other, the first locking body is constructed as a half-cylindrical piston that has a roundly tapered cross-section with two surfaces of the multiple curved surfaces and for which a tip of the roundly tapered cross-section of the piston is flattened, the curvatures of the two surfaces are formed by two corresponding radii having the identical lengths, which start from the structural center points that are different, and the second locking body is constructed as a hollow cylindrical holder for the first locking body, so that, in a locked state, two contact lines are active in a longitudinal direction of the first and second locking bodies between the first locking body and the second locking body.

6. A locking device for a switchable valve train component, the locking device comprising:

a first locking body and a second locking body that are brought into engagement with each other or are brought out of engagement with each other in order to couple or decouple two components arranged so that the two components are movable relative to each other, at least one of the first locking body or the second locking body has multiple curved surfaces each with curvatures that are defined by radii of identical length with structural center points that are spaced apart from each other, and the multiple curved surfaces:

(i) intersect with each other to form a gothic arc, or (ii) are spaced apart from each other by a flat connection tip.

* * * * *